US009204708B2

(12) United States Patent
Fidrych et al.

(10) Patent No.: US 9,204,708 B2
(45) Date of Patent: Dec. 8, 2015

(54) STRAP INCORPORATING A FLUID-FILLED BLADDER

(75) Inventors: Paul J. Fidrych, Portland, OR (US); Chris Helmsworth, Portland, OR (US); Tory Michael Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1585 days.

(21) Appl. No.: 11/434,553

(22) Filed: May 12, 2006

(65) Prior Publication Data

US 2007/0262106 A1 Nov. 15, 2007

(51) Int. Cl.
*A45F 3/12* (2006.01)
*A45F 3/02* (2006.01)

(52) U.S. Cl.
CPC .... *A45F 3/12* (2013.01); *A45F 3/02* (2013.01)

(58) Field of Classification Search
CPC ..... A45F 3/12; A45F 3/04; A45F 3/02; A63B 55/008; A45C 13/30
USPC ..... 224/264, 643
See application file for complete search history.

(56) References Cited

U.S. PATENT DOCUMENTS

| | | | | | |
|---|---|---|---|---|---|
| 900,610 | A | * | 10/1908 | Stow | 224/264 |
| 2,676,737 | A | * | 4/1954 | Zirbel | 224/264 |
| 3,883,053 | A | * | 5/1975 | Pritchard et al. | 224/264 |
| 4,327,909 | A | * | 5/1982 | Neufeld | 482/124 |
| 4,550,869 | A | * | 11/1985 | Johnson | 224/607 |
| 4,597,386 | A | * | 7/1986 | Goldstein | 602/19 |
| 4,682,587 | A | * | 7/1987 | Curlee | 602/13 |
| 4,682,588 | A | * | 7/1987 | Curlee | 602/13 |
| 4,699,401 | A | * | 10/1987 | Saenz | 280/808 |
| 4,756,306 | A | * | 7/1988 | Curlee | 602/19 |
| 4,815,639 | A | * | 3/1989 | Lehman | 224/159 |
| D337,197 | S | * | 7/1993 | Krutsch et al. | D3/327 |
| 5,322,349 | A | * | 6/1994 | Gianino | 297/482 |
| 5,595,332 | A | * | 1/1997 | Freedman | 224/264 |
| 5,632,429 | A | * | 5/1997 | Cantwell | 224/630 |
| 5,845,833 | A | * | 12/1998 | Murphy | 224/625 |
| D410,132 | S | * | 5/1999 | Hottenroth | D21/805 |
| 5,957,356 | A | * | 9/1999 | Potempa | 224/643 |
| D423,782 | S | * | 5/2000 | Ammerman et al. | D3/327 |

(Continued)

FOREIGN PATENT DOCUMENTS

| | | |
|---|---|---|
| DE | 675838 | 5/1939 |
| FR | 2813770 | 3/2002 |

(Continued)

OTHER PUBLICATIONS

International Preliminary Report on Patentability for International Application No. PCT/US2007/011201, mailed Nov. 27, 2008, 9 pages.

(Continued)

*Primary Examiner* — Justin Larson
*Assistant Examiner* — Peter Helvey
(74) *Attorney, Agent, or Firm* — Banner & Witcoff, Ltd.

(57) ABSTRACT

A strap may include a sheath and a fluid-filled bladder at least partially located within the sheath. The bladder has an elongate configuration that defines a first end, an opposite second end, and a central portion located between the first end and the second end. At least the central portion and the second end being unsecured to the sheath. In addition, the strap may include a pair of securing elements configured to join the strap to an article, and at least one of the securing elements may be joined to the second end of the bladder.

21 Claims, 12 Drawing Sheets

(56) References Cited

U.S. PATENT DOCUMENTS

| | | | | |
|---|---|---|---|---|
| 6,105,991 | A * | 8/2000 | Dodge et al. | 280/610 |
| 6,168,060 | B1 * | 1/2001 | Mayers | 224/645 |
| 6,220,492 | B1 * | 4/2001 | Huang | 224/264 |
| 6,223,959 | B1 * | 5/2001 | Chen | 224/264 |
| 6,279,795 | B1 * | 8/2001 | Pierzina | 224/150 |
| D448,170 | S * | 9/2001 | Ammerman et al. | D3/327 |
| 6,471,105 | B1 * | 10/2002 | Ammerman et al. | 224/625 |
| 6,644,522 | B2 * | 11/2003 | Preiss | 224/264 |
| 6,863,202 | B2 * | 3/2005 | Ammerman | 224/607 |
| 6,915,932 | B1 * | 7/2005 | Wolfe | 224/264 |
| 7,448,522 | B2 * | 11/2008 | Collier et al. | 224/264 |
| 2003/0163071 | A1 * | 8/2003 | Cominsky | 602/41 |
| 2004/0060951 | A1 * | 4/2004 | Kelly | 224/264 |
| 2004/0144816 | A1 * | 7/2004 | Ku | 224/264 |
| 2004/0144820 | A1 * | 7/2004 | Herold | 224/605 |

FOREIGN PATENT DOCUMENTS

| | | |
|---|---|---|
| GB | 219874 | 8/1924 |
| WO | 2003/061776 A1 | 7/2003 |

OTHER PUBLICATIONS

International Search Report for International Application No. PCT/US2007/011201, mailed Nov. 20, 2007, 4 pages.

Notice of Reasons for Rejection for Japanese patent application No. 2009-509833 mailed Jun. 8, 2011.

Office Communication for EP Application No. 07776919.8, issued Feb. 13, 2012.

* cited by examiner

STRAP INCORPORATING A FLUID-FILLED BLADDER

BACKGROUND

A variety of articles incorporate carry straps that assist with carrying the article. For example, a backpack generally incorporates a pair of straps that are configured to extend over both shoulders of an individual. Whereas the backpack often incorporates two straps, a messenger-style bag generally includes a single strap that extends over only one shoulder of the individual. Similarly, a golf bag conventionally includes either one strap or two straps that assist the individual with carrying golf equipment. Although some carry straps extend over or contact a shoulder, other carry straps contact a hand or other portions of an individual. For example, a handbag or purse may incorporate strap that is intended to be grasped by the hand. Accordingly, different types of articles may incorporate a variety of shoulder strap configurations.

One consideration in the design of a carry strap relates to comfort. In order to enhance the comfort of a strap, compressible materials are often incorporated into the strap in areas that contact the individual, such as the shoulder. An advantage of compressible materials in a strap relates to decreased pressure concentrations on the shoulders of the individual, and particularly in areas of the shoulder that include the suprascapular nerve. When a strap extends over the shoulder, some areas of the shoulder experience greater loads than other areas of the shoulder, thereby forming pressure concentrations in the areas of greater loads. Compressible materials may be utilized, therefore, to distribute loads more evenly over a surface of the shoulder and decrease the pressure concentrations.

Examples of compressible materials suitable for strap applications include polymer foams and fluid-filled bladders. U.S. Pat. No. 6,915,932 to Wolfe discloses a strap having a foam element and a fluid-filled bladder. The foam element defines various indentations, and the bladder is positioned within the indentations such that a combination of the foam element and the bladder provides cushioning when carrying an article. U.S. Pat. No. 6,223,959 to Chen discloses a strap for a golf bag, the strap having an envelope that encloses an air pocket formed of an inflated thermoplastic material. Similarly, U.S. Pat. Nos. 5,566,871 and 5,361,957 to Weintraub both disclose cushioning devices intended for use in a shoulder strap that incorporate an air-filled member.

SUMMARY

Various aspects of the invention involve a strap that includes a sheath and a fluid-filled bladder at least partially located within the sheath. The bladder has an elongate configuration that defines a first end, an opposite second end, and a central portion located between the first end and the second end. At least the central portion and the second end being unsecured to the sheath. In addition, the strap may include a pair of securing elements configured to join the strap to an article, and at least one of the securing elements may be joined to the second end of the bladder.

The bladder may be formed as a polymer tube that is sealed at each of the first end and the second end. In addition, the central portion of the bladder may have a plurality of bonds that secure opposite sides of the polymer tube to each other. Although the fluid within the bladder may be pressurized, the fluid may also be air at a pressure substantially equal to a pressure of ambient air surrounding the strap.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following material and accompanying figures disclose a strap that may be secured to various articles and utilized to assist in carrying the articles. The strap is disclosed in combination with a computer bag, but concepts associated with the strap may also be utilized in combination with a wide range of other bag styles, including backpacks, briefcases, camera bags, duffel bags, golf bags, handbags, messenger bags, and purses, for example. In addition to bags, concepts associated with the strap may be utilized in combination with a variety of other articles, including photographic equipment (i.e., cameras), binoculars, and various types of athletic equipment. Various harness configurations may also incorporate concepts associated with the strap, including seatbelts, hang gliding harnesses, parachuting harnesses, and horse tack, for example. An individual skilled in the relevant art will appreciate, therefore, that the concepts disclosed herein apply to strap configurations that are suitable for use with a variety of articles and for a wide variety of purposes.

Figure 1:
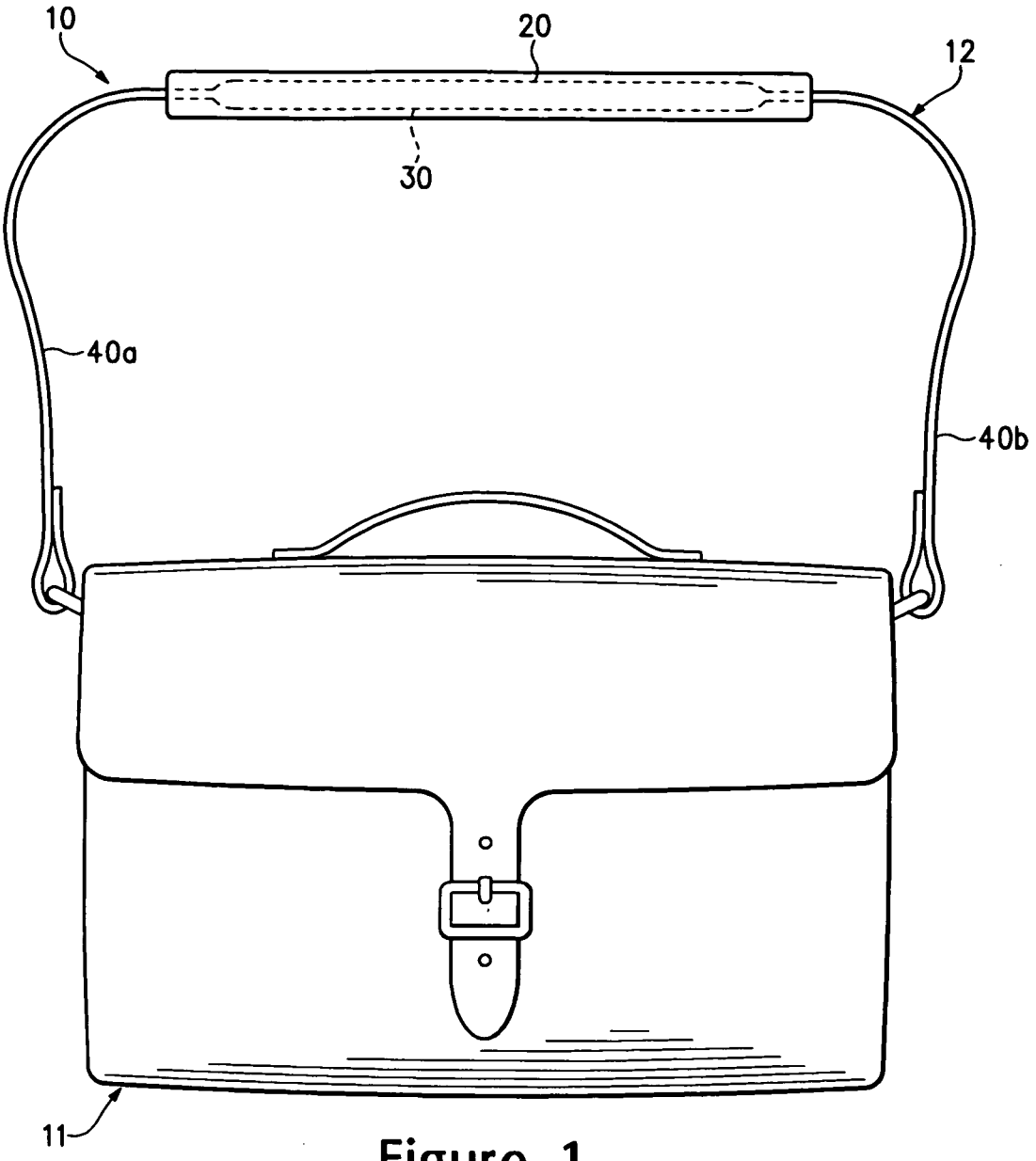
FIG. 1 is an elevational view of a bag incorporating a strap.

With reference to FIG. 1, a computer bag 10 is disclosed as including a container portion 11 and a carry strap 12. Bag 10 may be utilized to protect and transport various contents, including a notebook computer, accessories for the computer, and documents, for example. Accordingly, container portion 11 has a generally conventional configuration that is substantially hollow to accommodate the contents. Strap 12 is secured to container portion 11 in two locations to form a structure that extends over a shoulder of an individual, thereby permitting the individual to carry bag 10 and the contents. Although loop-style connectors are depicted, a variety of other connection styles may be utilized to secure strap 12 to container portion 11.

Figure 2:
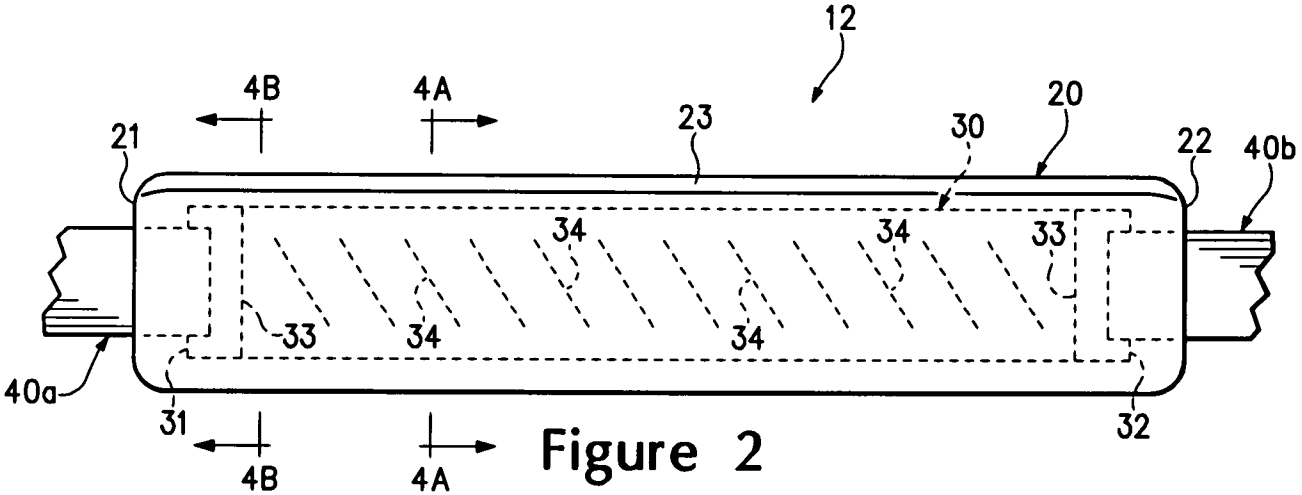
FIG. 2 is a top plan view of the strap.
Figure 3:
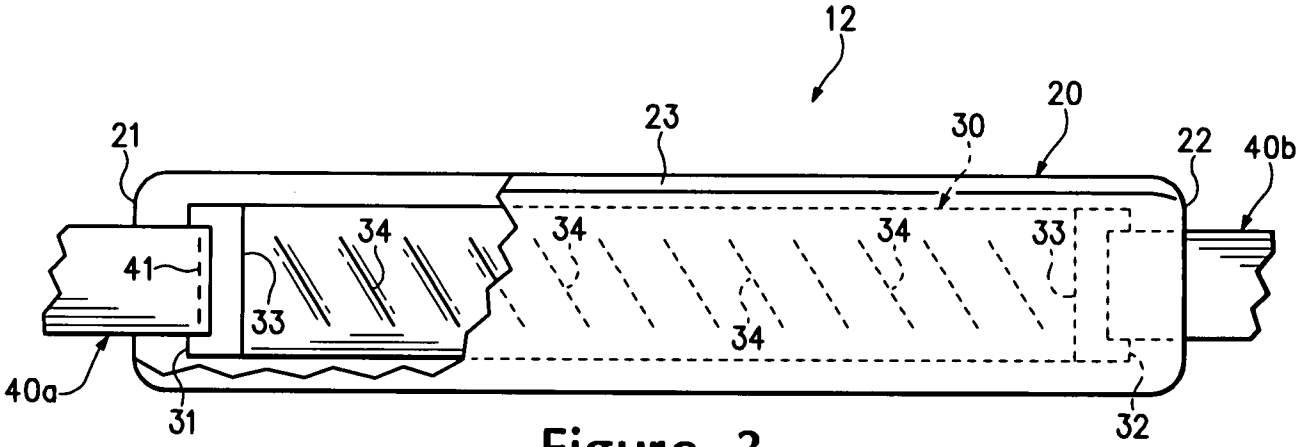
FIG. 3 is a fragmentary top plan view of the strap.

Strap 12 is depicted individually in FIGS. 2 and 3 and includes a sheath 20, a bladder 30, and a pair of extensions

40*a* and 40*b*. Sheath 20 forms a portion of an exterior surface of strap 12 and makes direct contact with the shoulder of the individual during use. Bladder 30 is a fluid-filled member at least partially located within a void in sheath 20 to enhance the cushioning properties of strap 12. Furthermore, extensions 40*a* and 40*b* extend outward from the combination of sheath 20 and bladder 30 to form securing elements that join with container portion 11. Sheath 20 and bladder 30 are approximately centered between areas where securing elements 40*a* and 40*b* join with container portion 11, as depicted in FIG. 1.

Figure 4A:
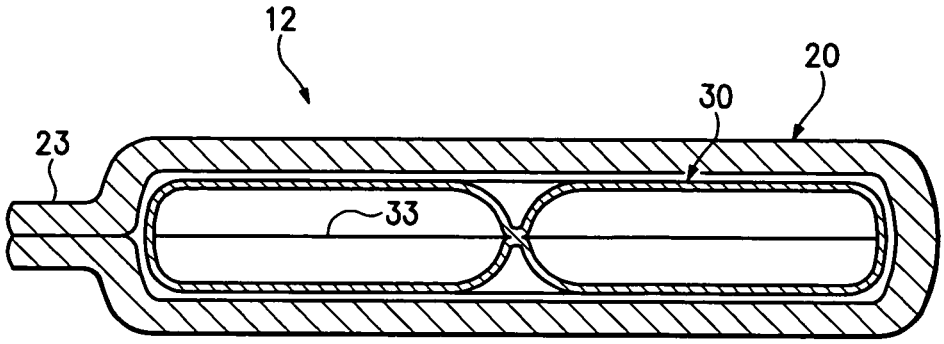
FIGS. 4A and 4B are cross-sectional views of the strap, as defined by section lines 4A and 4B in FIG. 2.
Figure 4B:
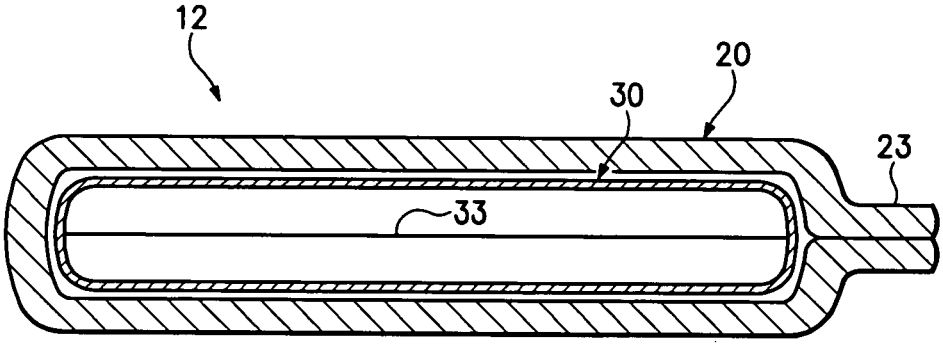

Sheath 20 has an elongate configuration that defines a first end 21, a second end 22, and an edge 23 extends between ends 21 and 22. As depicted in FIGS. 4A and 4B, sheath 20 is formed from a material element that is folded over such that edges of the material element are joined along edge 23. The void within sheath 20, which receives bladder 30, is located between opposing surfaces of the material element. More particularly, the void that receives bladder 30 extends at least partially along the length of sheath 20. The specific manner in which sheath 20 is constructed may, however, vary significantly to include a variety of other configurations that at least partially enclose bladder 30. In addition, the specific shape of sheath 20 may vary to include curved or angled configurations, for example.

Suitable materials for sheath 20 include polymer foams, a variety of textiles, leather, synthetic leather, and polymer sheets, for example. Although bladder 30 provides cushioning to strap 12, polymer foams may be incorporated into sheath 20 in order to provide a further degree of cushioning. Spacer-knit mesh textiles, for example, may also be utilized to impart cushioning properties. Combinations of materials may also be utilized. For example, a textile may be bonded to a polymer foam element to form portions of sheath 20, or a majority of sheath 20 may be formed from a spacer-knit mesh textile, with synthetic leather utilized for high-wear areas or portions requiring additional strength. Transparent elements may also be utilized to make portions of bladder 30 visible. Accordingly, a variety of materials may be incorporated into strap 12 to form sheath 20.

Bladder 30 is located within the void in sheath 20 and provides cushioning to strap 12. In addition, bladder 30 forms a tensile member that bears or otherwise supports the weight of container portion 11 and the contents of container portion 11. Bladder 30 is primarily formed from a polymer material that encloses a fluid, such as air, which may be pressurized or at substantially ambient pressure. Bladder 30 has a tubular configuration with a first end 31 and an opposite second end 32. First end 31 is positioned adjacent to first end 21 of sheath 20, and second end 32 is positioned adjacent to second end 22 of sheath 20. In order to seal the fluid within bladder 30, a pair of sealing bonds 33 are formed in ends 31 and 32. In addition, a plurality of interior bonds 34 are formed between opposite sides of bladder 30 to impart a relatively flat configuration to bladder 30. That is, interior bonds 34 decrease the overall thickness of bladder 30 to impart a shape that fits within the void in sheath 20.

Interior bonds 34 may exhibit a variety of configurations. As depicted, interior bonds 34 are elongate bonds oriented diagonal to a longitudinal axis of bladder 30. Whereas sealing bonds 33 extend entirely across the width of bladder 30, interior bonds 34 are spaced from edges of bladder 30 to permit the fluid to move throughout bladder 30. In some configurations, interior bonds 34 may be perpendicular to the edges of bladder 30, interior bonds 34 may be dots rather than lines, interior bonds 34 may extend entirely across the width of bladder 30, or interior bonds 34 may have other shapes. For example, interior bonds 34 could be circular bonds, nonlinear bonds, or interior bonds may be absent. An advantage to forming interior bonds 34 to have an elongate configuration is that interior bonds 34 form flexion lines in bladder 30.

A variety of thermoplastic polymer materials may be utilized for bladder 30, including polyurethane, polyester, polyester polyurethane, and polyether polyurethane. Another suitable material for bladder 30 is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Bladder 30 may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference.

The fluid within bladder 30 may be any of the gasses disclosed in U.S. Pat. No. 4,340,626 to Rudy, hereby incorporated by reference, such as hexafluoroethane and sulfur hexafluoride, for example. The fluid may also include gasses such as pressurized octafluorapropane, nitrogen, or air. In addition to gasses, various gels or liquids may be sealed within bladder 30. Accordingly, a variety of fluids are suitable for bladder 30. With regard to pressure, a suitable fluid pressure is fifteen pounds per square inch, but may range from zero to thirty pounds per square inch. Accordingly, the fluid pressure within bladder 30 may be relatively high, or the fluid pressure may be at ambient pressure or at a pressure that is slightly elevated from ambient in some embodiments of the invention.

Extensions 40*a* and 40*b* are secured to opposite sides of bladder 30 and extend outward from sheath 20 to join with container portion 11. Suitable materials for extensions 40*a* and 40*b* include a variety of conventional materials, such as nylon webbing. With reference to FIG. 3, extension 40*a* is depicted as being secured to bladder 30 with stitching 41. More particularly, one of sealing bonds 33 is spaced from first end 31 to form a flanged area of bladder 30 that does not enclose the fluid. Stitching 41 extends, therefore, through each of extension 40*a* and the flanged area of bladder 30 to secure extension 40*a* to bladder 30. A similar configuration may be utilized to secure extension 40*b* to second end 32. As alternatives to stitching 41, extensions 40*a* and 40*b* may be adhesively secured or heat bonded to bladder 30, for example.

Figure 5:
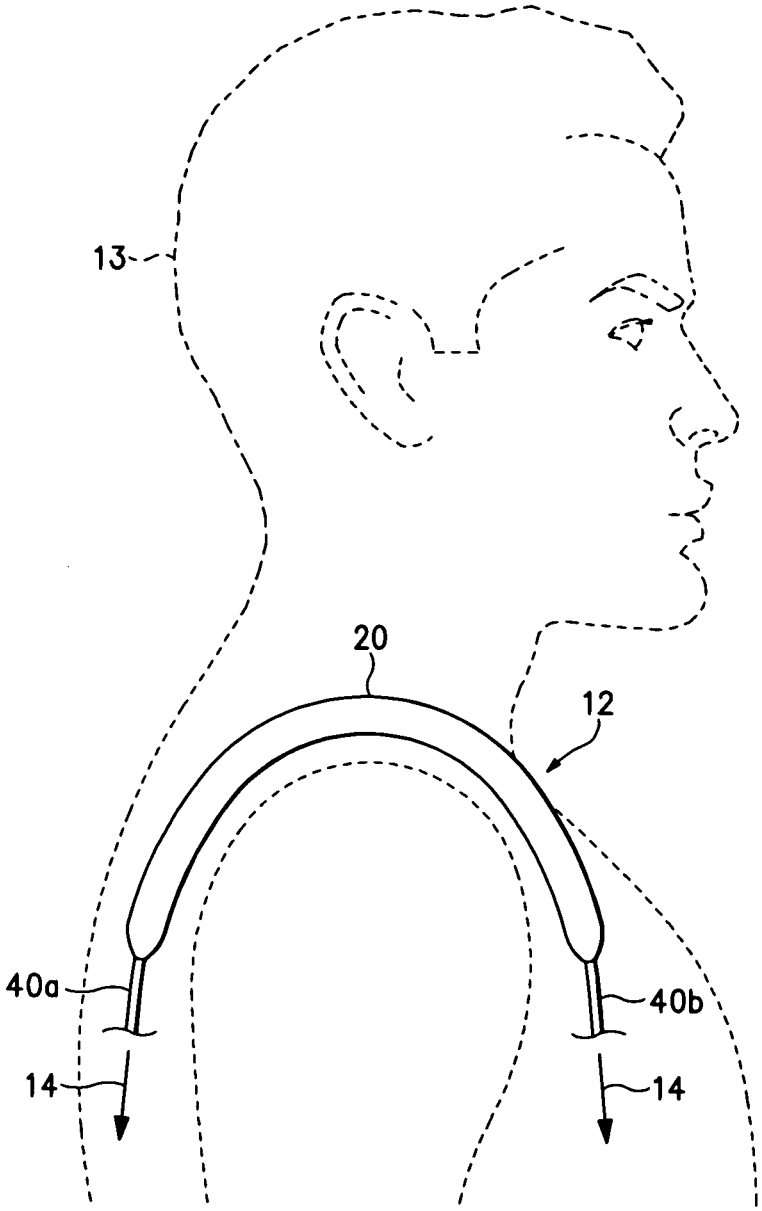
FIG. 5 is a schematic side elevational view of the strap extending over a shoulder of an individual.

Bladder 30 is located within the void in sheath 20 and is substantially unsecured to sheath 20. Accordingly, bladder 30 is free to move within sheath 20 and may, if desired, be removed from sheath 20 without damaging the structure of sheath 20. With reference to FIG. 5, strap 12 is schematically-depicted as extending over and resting upon the shoulder of an individual 13. Each of extensions 40*a* and 40*b* are secured to container portion 11 and are in tension due to the combined weight of container portion 11 and the contents of container portion 11. That is, the combined weight of container portion 11 and the contents of container portion 11 induce a tensile force on extensions 40*a* and 40*b*, which is represented by arrows 14. Given that bladder 30 is secured to each of extensions 40*a* and 40*b*, the tensile force is also induced in bladder 30. Accordingly, bladder 30 forms a tensile member that bears or otherwise supports the combined weight of container portion 11 and the contents of container portion 11.

Figure 6:
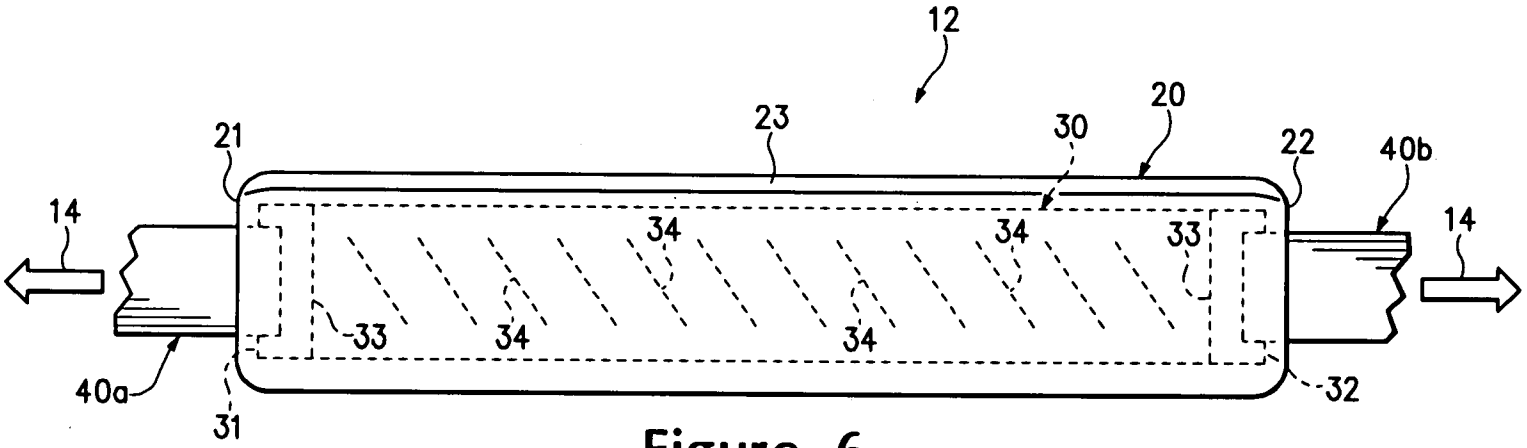
FIG. 6 is a top plan view of the strap in tension.

As noted above, bladder 30 is unsecured to sheath 20 and is free to move within sheath 20. Upon the application of the tensile force, bladder 30 may stretch in proportion to the tensile force. With reference to FIG. 6, strap 12 is depicted in a state wherein the tensile force represented by arrows 14 is applied to extensions 40*a* and 40*b*, thereby stretching or otherwise elongating bladder 30 such that ends 31 and 32 are relatively close to ends 21 and 22 of sheath 20. In comparison with FIG. 2, therefore, bladder 30 is elongated, but the overall length of sheath 20 remains substantially constant whether strap 12 is in a stretched or unstretched state. Accordingly, applying a tensile force to extensions 40*a* and 40*b* tends to stretch bladder 30 without substantially changing the proportions of sheath 20.

Whereas bladder 30 and extensions 40*a* and 40*b* are placed in tension, sheath 20 is in a substantially non-tensioned state because bladder 30 is unsecured to sheath 20. Accordingly, the configuration of strap 12 depicted in FIGS. 1-6 does not incorporate a structure that transfers the tensile force to sheath 20 from bladder 30 or extensions 40*a* and 40*b*. In a strap where tensile force is transferred to a sheath, the sheath generally incorporates materials that not only impart cushioning and wear-resistance, but also have sufficient tensile strength to endure the tensile force. In strap 12, however, the materials selected for sheath 20 may be primarily selected to impart cushioning and wear-resistance, for example, with less emphasis being placed on tensile strength. An advantage of this configuration is that a wider range of materials may be selected for sheath 20.

While strap 12 may incorporate a polymer foam material, strap 12 is depicted in the figures as having a non-foam material, such as a textile, for sheath 20. In this configuration, sheath 20 provides a covering for bladder 30 and assists with protecting bladder 30 from wear, and bladder 30 provides cushioning for strap 12. In some prior art strap configurations that incorporate fluid-filled bladders, the bladders were coupled with foam to enhance the cushioning properties of the straps. Although strap 12 may incorporate a polymer foam material, bladder. 30 may provide sufficient cushioning without an additional polymer foam material.

Figure 7A:
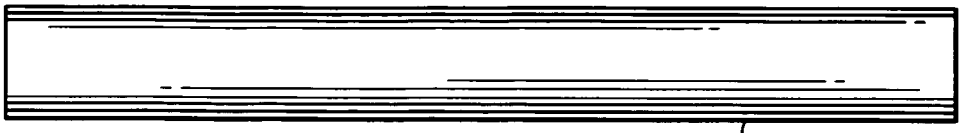
FIGS. 7A-7C are schematic top plan views showing a first manufacturing method for the bladder portion.
Figure 7B:
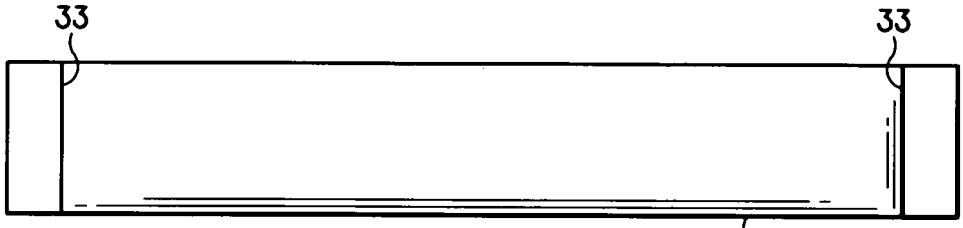
Figure 7C:
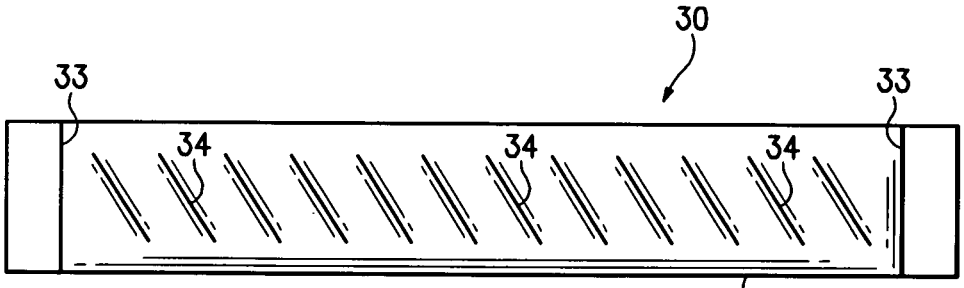

One manufacturing method for bladder 30 is depicted in FIGS. 7A-7C. With reference to FIG. 7A, a tubular member 15 is initially formed from a polymer material by, for example, extrusion. Although tubular member 15 is depicted as having a substantially circular cross-section, tubular member may have an elliptical, square, or rectangular cross-section, for example. Following the formation of tubular member 15, sealing bonds 33 are formed in end portions of tubular member 15, as depicted in FIG. 7B. That is, a hot die or mold may be utilized to heat the end portions of tubular member 15 and bond opposite sides of the end portions to each other. The formation of sealing bonds 33 effectively seals air or another fluid within tubular member 15. In addition, the formation of sealing bonds 33 has the effect of flattening or otherwise decreasing the overall height of tubular member 15, while increasing the width of tubular member 15. With reference to FIG. 7C, interior bonds 34 are then formed between opposite sides of tubular member 15, thereby substantially completing the manufacture of bladder 30. As with sealing bonds 33, a hot die or mold may be utilized to heat and bond opposite sides of tubular member 15 to each other. Although the various steps outlined in FIGS. 7A-7C are discussed and depicted individually, various steps may be performed or otherwise carried-out simultaneously.

Figure 8A:
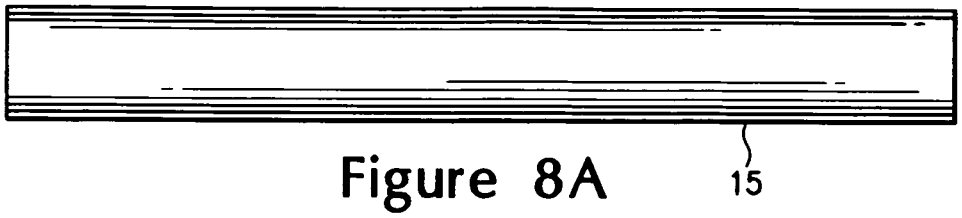
FIGS. 8A-8D are schematic top plan views showing a second manufacturing method for the bladder portion.
Figure 8B:
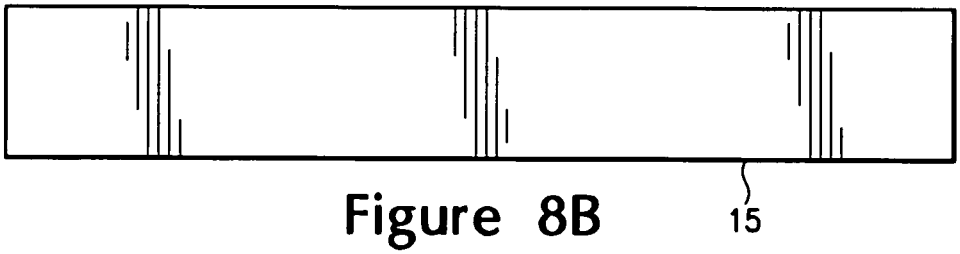
Figure 8C:
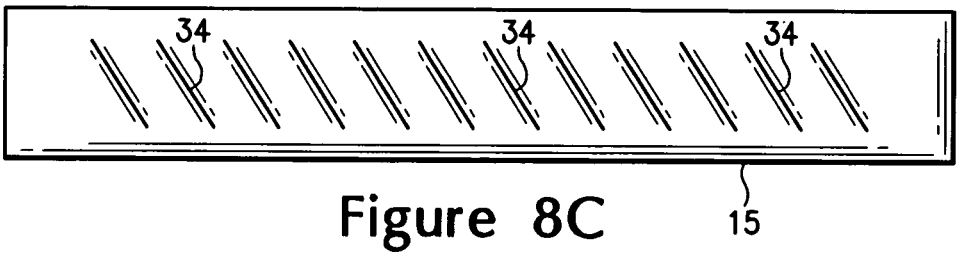
Figure 8D:
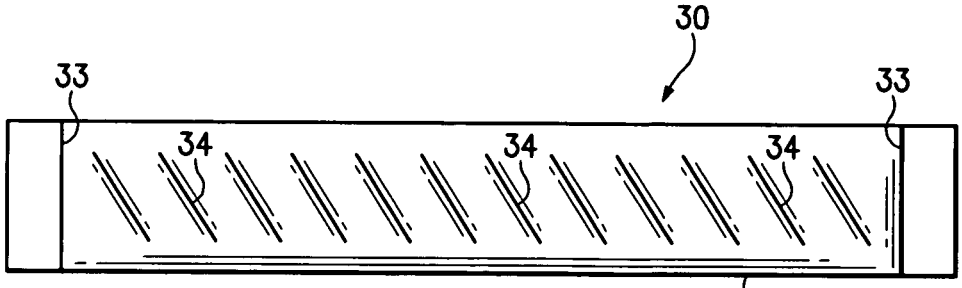

Another manufacturing method for bladder 30 is depicted in FIGS. 8A-8D. With reference to FIG. 8A, tubular member 15 is initially formed from a polymer material by, for example, extrusion Although tubular member 15 is depicted as having a substantially circular cross-section, tubular member may have an elliptical, square, or rectangular cross-section, for example. Following the formation of tubular member 15, a press or other device is utilized to flatten or otherwise decrease the overall height of tubular member 15, while increasing the width of tubular member 15, as depicted in FIG. 8B. With reference to FIG. 8C, interior bonds 34 are then formed between opposite sides of tubular member 15. More particularly, a hot die or mold may be utilized to heat and bond opposite sides of tubular member 15 to each other. Sealing bonds 33 are then formed, as depicted in FIG. 8D, to substantially complete the manufacture of bladder 30. Although the various steps outlined in FIGS. 8A-8D are discussed and depicted individually, various steps may be performed or otherwise carried-out simultaneously.

In each of the manufacturing methods for bladder 30 discussed above, tubular member 15 is initially formed from a polymer material by, for example, extrusion. A variety of other manufacturing techniques may also be utilized for bladder 30, including twin-sheet bonding, various thermoforming processes; and blowmolding. In twin-sheet bonding, two sheets of polymer material are bonded together to form a tubular structure. Thermoforming also involves bonding two sheets of polymer material together, but also includes heating and forming the sheets. In addition, blowmolding involves expanding a parison in a mold having the shape of bladder 30. Accordingly, a variety of manufacturing techniques may be utilized for bladder 30.

Figure 9:
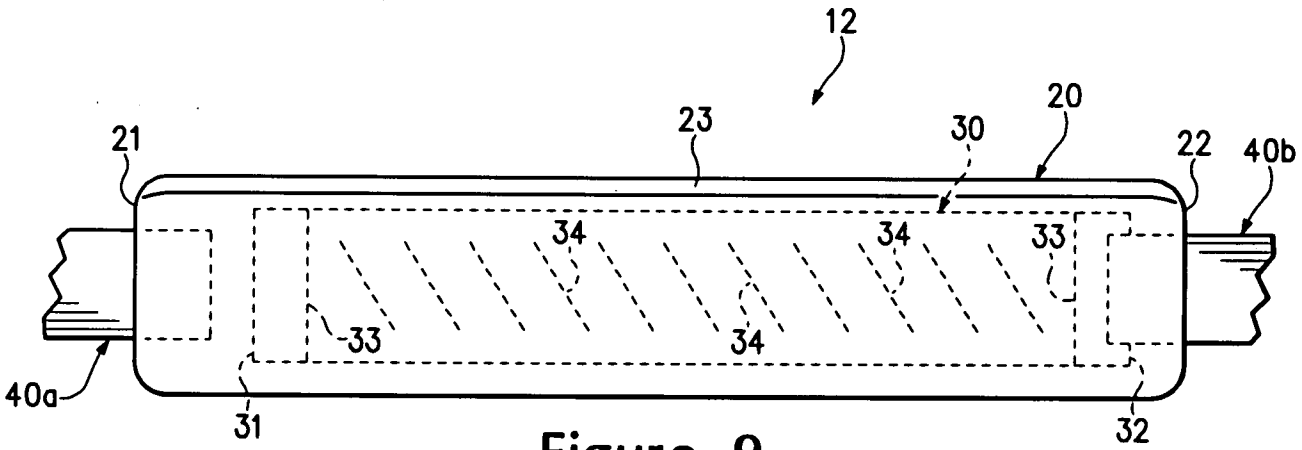
FIG. 9 is a top plan view of another strap.
Figure 10:
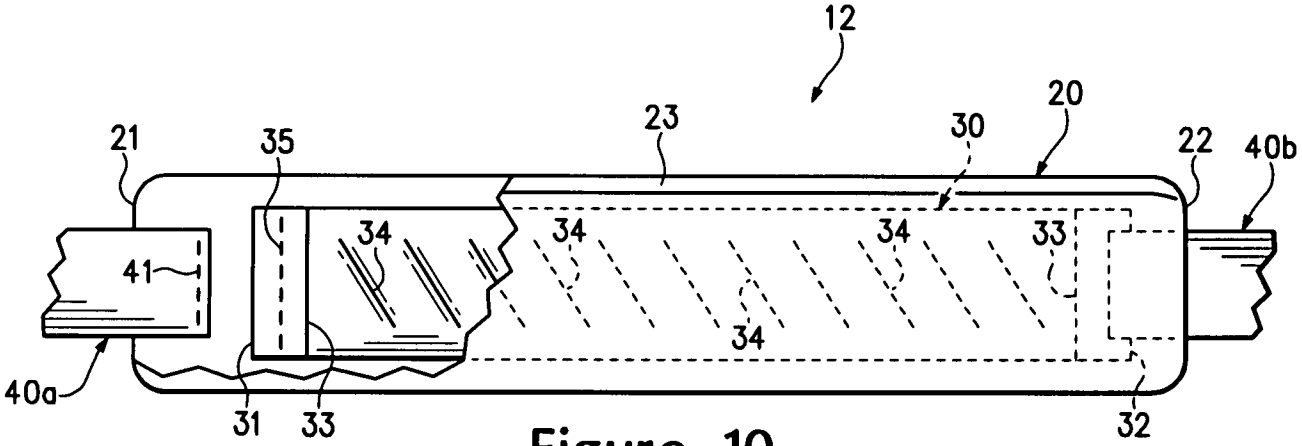
FIG. 10 is a fragmentary top plan view of the strap depicted in FIG. 9.

Another configuration for strap 12 is depicted in FIGS. 9 and 10. Whereas bladder 30 was unsecured to sheath 20 in the configuration of FIGS. 2 and 3, first end 31 of bladder 30 is depicted as being secured to sheath 20 in FIGS. 9 and 10. More particularly, stitching 35 is utilized to join first end 31 to an area that is adjacent first end 21 of sheath 20. That is, stitching 35 extends through each of the flanged area of bladder 30 and sheath 20 to secure bladder 30 to sheath 20. Separately, extension 40*a* is secured to sheath 20 with stitching 41. In other configurations, extension 40*a* may contact first end 31 such that each of extension 40*a*, first end 31, and sheath 20 may be joined with a single area of stitching. As alternatives to stitching 35, bladder 30 may be adhesively secured or heat bonded to sheath 20, for example.

Figure 11:
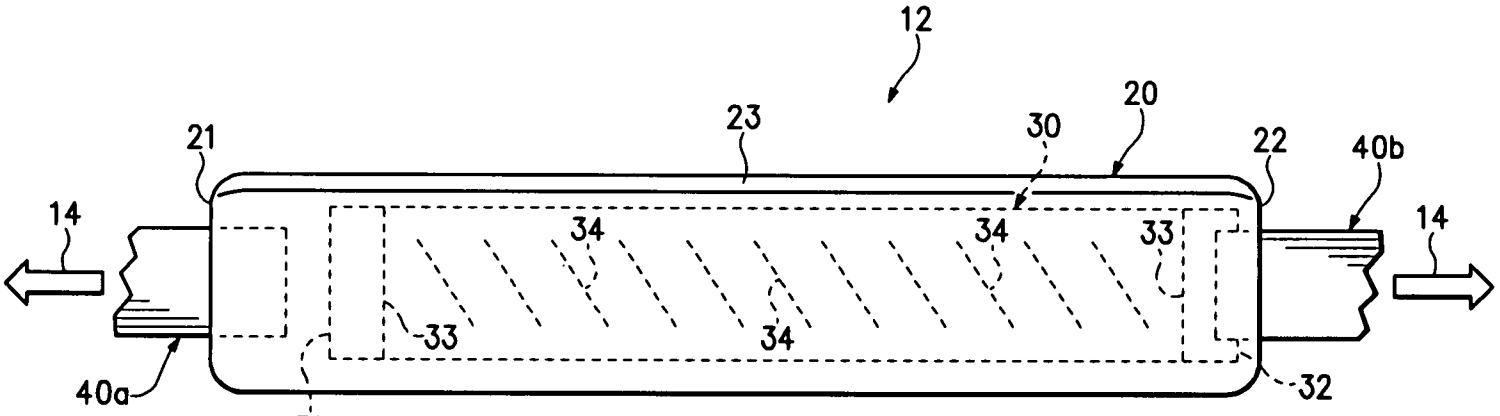
FIG. 11 is a top plan view of the strap depicted in FIG. 9 in tension.

Although first end 31 of bladder 30 is secured to sheath 20 in the configuration of FIGS. 9 and 10, bladder 30 remains substantially unsecured to sheath 20. That is, a central area of bladder 30 and second end 32 remain unsecured to sheath 20. Moreover, extension 40*b* is secured to second end 32. Upon the application of the tensile force, bladder 30 may stretch in proportion to the tensile force. With reference to FIG. 11, strap 12 is depicted in a state wherein a tensile force represented by arrows 14 is applied to extensions 40*a* and 40*b*, thereby stretching or otherwise elongating bladder 30 such that end 32 extends toward end 22 of sheath 20. In comparison with FIG. 9, therefore, bladder 30 is elongated, but the overall length of sheath 20 remains substantially constant.

Whereas bladder 30 and extensions 40*a* and 40*b* are placed in tension, sheath 20 is in a substantially non-tensioned state except in the area between first end 31 and extension 40*a*. Sheath 20 may, therefore, be constructed to resist the tensile force in areas adjacent to first end 21. The materials selected for a remainder of sheath 20 may be primarily selected to impart cushioning and wear-resistance, for example, with less emphasis being placed on tensile strength.

Figure 12:
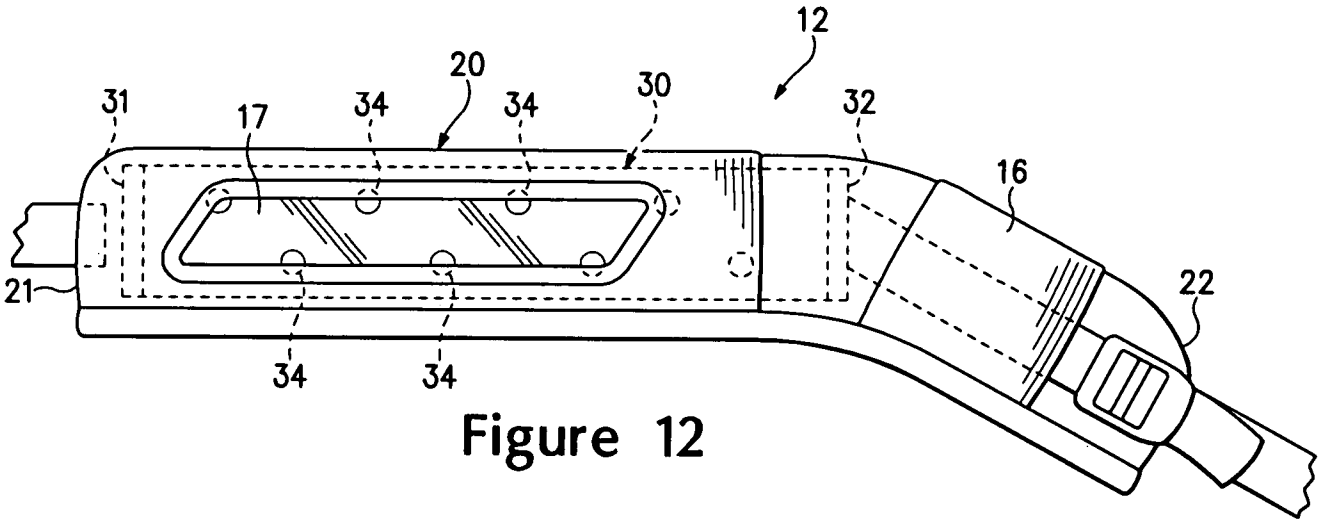
FIG. 12 is a top plan view of yet another strap.

Yet another configuration for strap 12 is depicted in FIG. 12. Whereas strap 12 has a substantially straight or otherwise linear shape in prior configurations, strap 12 is depicted as having an angled shape in FIG. 12. Additionally, a reinforcing member 16 is located at a position where extension 40*b* exits sheath 20 to impart additional durability to this area. Furthermore, sheath 20 includes a transparent member 17 located adjacent first end 21, thereby making a portion of bladder 30 visible from an exterior of strap 12. Suitable materials for transparent member 17 include a clear polymer layer or a mesh textile, for example. Whereas interior bonds 34 are depicted in other configurations as having a linear shape, interior bonds 34 are depicted as being dots or otherwise having a circular shape in FIG. 12.

Transparent member 17 may be a textile material or a polymer film, for example. In some configurations where transparent member 17 is a polymer film, transparent member 17 may be bonded to bladder 30 and have elastic or otherwise stretchable properties. As bladder 30 is placed in tension and stretches, transparent member 17 may stretch in a corresponding manner so as to not inhibit the stretch in bladder 30. Although transparent member 17 is depicted as extending along only a portion of the length of bladder 30, transparent member 17 may extend along the entire length of bladder 30 in some configurations of strap 12.

Based upon the above discussion, strap 12 has a configuration wherein bladder 30 is at least partially located within sheath 20. Bladder 30 has an elongate configuration, and at least the central portion and second end 32 are unsecured to sheath 20. That is, first end 31 may be secured or unsecured to sheath 20 in various configurations of strap 12. In addition to providing cushioning, therefore, bladder 30 forms a tensile member that bears or otherwise supports the weight of container portion 11 and the contents of container portion 11.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. A strap comprising:

a sheath;

a fluid-filled bladder at least partially located within the sheath, the bladder having an elongate configuration that defines a pair of ends, the bladder being unsecured to the sheath, wherein the bladder is an elongated polymer tube that is sealed by a pair of sealing bonds, one sealing bond at each of the ends, wherein a fluid within the elongated polymer tube is communicable throughout a sealed portion of the polymer tube between the pair of sealing bonds, and wherein the sealing bonds are spaced inwardly from the ends of the polymer tube forming a pair of flanged areas that define ends of the polymer tube that do not enclose the fluid; and a pair of extensions comprising a first extension secured to a first flanged area of the pair of flanged areas and a second extension secured to a second flanged area of the pair of flanged areas, wherein the pair of extensions are unsecured to the sheath and wherein the first extension is different from the second extension.

2. The strap recited in claim 1, wherein the extensions are configured to secure to an article.

3. The strap recited in claim 1, wherein the polymer tube comprises a single continuous tube.

4. The strap recited in claim 3, wherein a plurality of bonds secure opposite sides of the polymer tube to each other.

5. The strap recited in claim 4, wherein the bonds have an elongate configuration and are oriented diagonal to a longitudinal axis of the bladder.

6. The strap recited in claim 3, wherein opposite sides of the polymer tube are secured to each other in a plurality of discrete locations between the ends.

7. The strap recited in claim 1, wherein the fluid within the bladder is air.

8. The strap recited in claim 7, wherein a pressure of the air is substantially equal to a pressure of ambient air surrounding the strap.

9. The strap recited in claim 1, wherein the extensions are formed from webbing material.

10. The strap recited in claim 1, wherein the sheath is at least partially formed from a transparent material, and the bladder is visible through the transparent material.

11. The strap recited in claim 1, wherein the extensions are secured to an article to form a carry strap for the article.

12. A strap comprising:

a sheath; and a fluid-filled bladder at least partially located within the sheath, the bladder having an elongate configuration that defines a first end, an opposite second end, and a central portion located between the first end and the second end, at least the central portion and the second end being unsecured to the sheath, wherein the bladder comprises a polymer tube extending between the first and second ends and sealed at the first and second ends by first and second sealing bonds, respectively, wherein a fluid within the bladder is communicable throughout a sealed portion of the polymer tube between the pair of sealing bonds, and wherein at least the second sealing bond is spaced inwardly from the second end of the polymer tube forming a flanged area that defines a second end of the polymer tube that does not enclose the fluid; and a pair of extensions configured to join the strap to an article, at least one of the extensions being joined to the flanged area at the second end of the bladder.

13. The strap recited in claim 12, wherein the extension joined to the flanged area at the second end of the polymer tube is joined by one of stitching, adhesively securing, and heat bonding the extension to the flanged area.

14. The strap recited in claim 12, wherein the central portion of the bladder has a plurality of bonds that secure opposite sides of the polymer tube to each other.

15. The strap recited in claim 12, wherein the fluid within the bladder is air at a pressure substantially equal to a pressure of ambient air surrounding the strap.

16. The strap recited in claim 12, wherein the sheath is at least partially formed from a transparent material, and the bladder is visible through the transparent material.

17. The strap recited in claim 12, wherein the extensions are secured to the article to form a carry strap for the article.

18. A strap comprising a sheath and a fluid-filled bladder at least partially located within the sheath, neither the sheath nor the bladder including a polymer foam material, wherein the fluid-filled bladder comprises a polymer tube, the polymer tube including:

a first end;

a second end;

a pair of sealing bonds, each sealing bond spaced inwardly from one of the first and second ends of the polymer tube, forming a pair of flanged areas that define ends of the polymer tube that do not enclose the fluid; and an interior portion between the first end and the second end, wherein a top surface of the polymer tube is joined with a bottom surface of the polymer tube within the interior portion by a plurality of distinct bonds such that a fluid within the polymer tube is communicable throughout an entirety of the polymer tube, and wherein the top surface and bottom surface of the polymer tube are exterior surfaces of the fluid-filled bladder.

19. The strap recited in claim 18, wherein the bladder has an elongate configuration that defines a first end and an opposite second end, the first end being secured to the sheath, and a remainder of the bladder being unsecured to the sheath.

20. The strap recited in claim 19, wherein the bladder is a polymer tube that is sealed at each of the first end and the second end.

21. The strap recited in claim 18, wherein the fluid within the bladder is air, and a pressure of the air is substantially equal to a pressure of ambient air surrounding the strap.

* * * * *